US005500962A

United States Patent [19]

Tagg

[11] Patent Number: 5,500,962

[45] Date of Patent: Mar. 26, 1996

[54] OUTDOOR TOILET CABANA

[75] Inventor: Richard L. Tagg, Sandhutton, England

[73] Assignee: Polyjohn Enterprises Corporation, Gaspar, Ind.

[21] Appl. No.: 380,680

[22] Filed: Jan. 30, 1995

[51] Int. Cl.[6] ..... A47K 11/04

[52] U.S. Cl. ..... 4/476; 4/449; 52/79.1; 52/282.1

[58] Field of Search ..... 4/317, 318, 321, 4/322, 323, 449, 450, 460, 462, 463, 476–479, 483; 52/27.5, 79.1, 270, 282.1, 582.1

[56] References Cited

U.S. PATENT DOCUMENTS

| | | | |
|---|---|---|---|
| 3,938,199 | 2/1976 | Laven | 52/282.1 X |
| 4,831,671 | 5/1989 | Harding | 4/460 |
| 4,968,171 | 11/1990 | Shell | 52/282.1 X |
| 5,398,465 | 3/1995 | Tagg | 4/460 X |

*Primary Examiner*—Charles E. Phillips
*Attorney, Agent, or Firm*—Harness, Dickey & Pierce

[57] ABSTRACT

An outdoor toilet cabana is formed of pair of side walls whose opposite vertical edges are bent to form angled corner sections having their free edge portions bent into vertical strip-like flanges that extend in approximately the same plane towards the opposite, corresponding flanges of the opposite wall. A rear wall has side edge strip-like portions that are aligned in approximately the same plane as the flanges of the side wall. Extruded strips are formed with oppositely opening channels to receive the adjacent side wall flanges and rear wall edge portions. These channels are deeper than the portions of the flanges and rear wall strips received therein so that they can accommodate variations in wall dimensions while still providing a rigid cabana of pre-determincd size. A doorway is formed between the flanges on the forward side of the side walls. A substantially continuous extruded doorway edge strip extends along the jambs and the header of the doorway. The extruded doorway strip is provided with a channel for receiving the flanges of the side walls and for receiving a depending flange formed on a roof arranged over the walls. In addition, the doorway strip is provided with a second, drain channel positioned on the forward outer surface of the cabana for directing rain water from the header and roof along the side jambs of the doorway. The doorway strip includes a substantially continuous flange extending inwardly of the doorway to provide a stop for a door arranged within the doorway. The channel of the doorway strip which receives the wall and roof flanges is deeper than the normally received portions of those flanges for accommodating variations in dimensions of the side walls and roof.

16 Claims, 4 Drawing Sheets

FIG-1
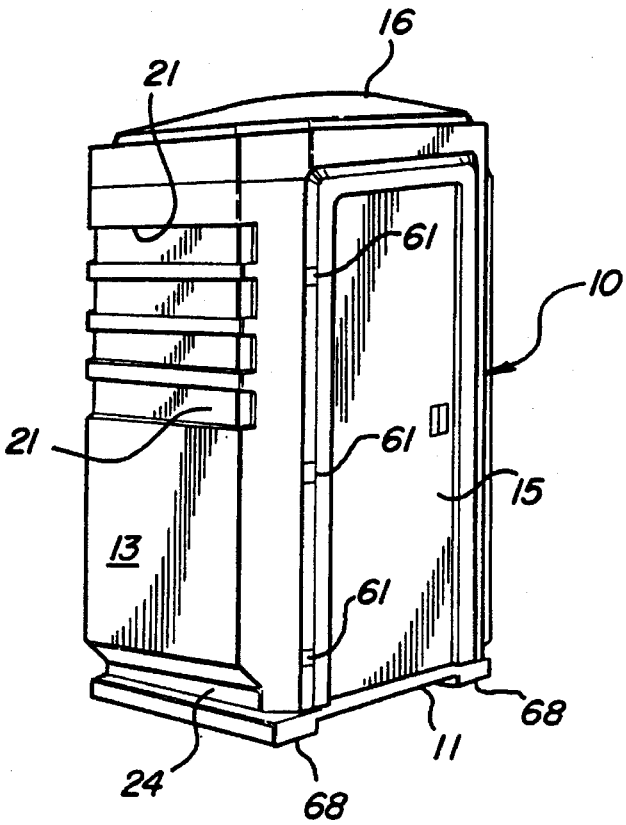
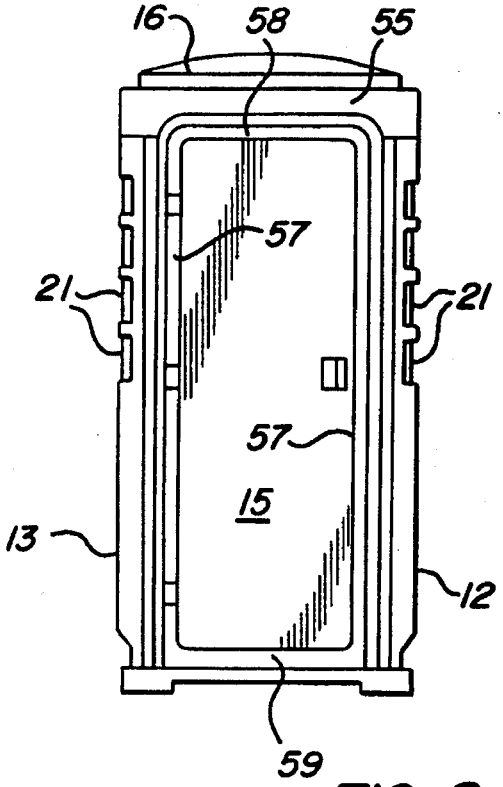
FIG-2
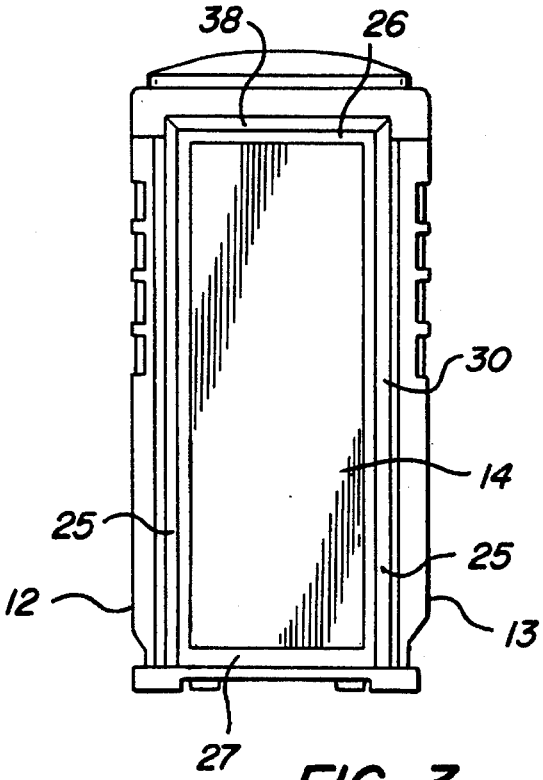
FIG-3
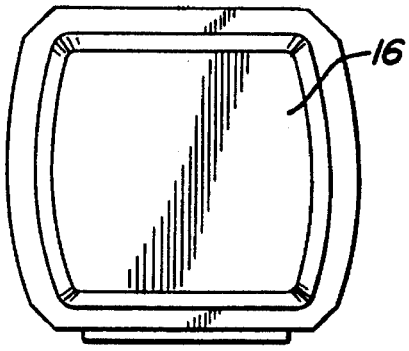
FIG-4

FIG-6
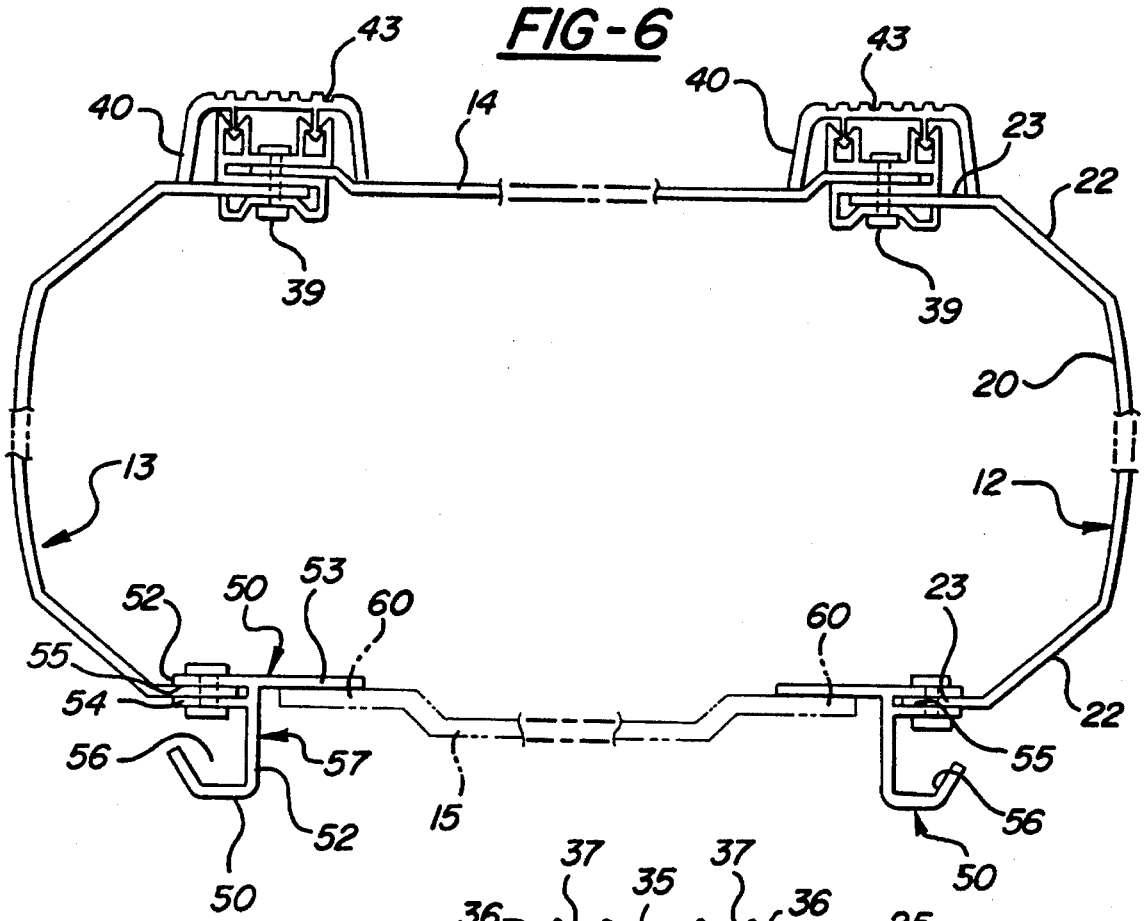
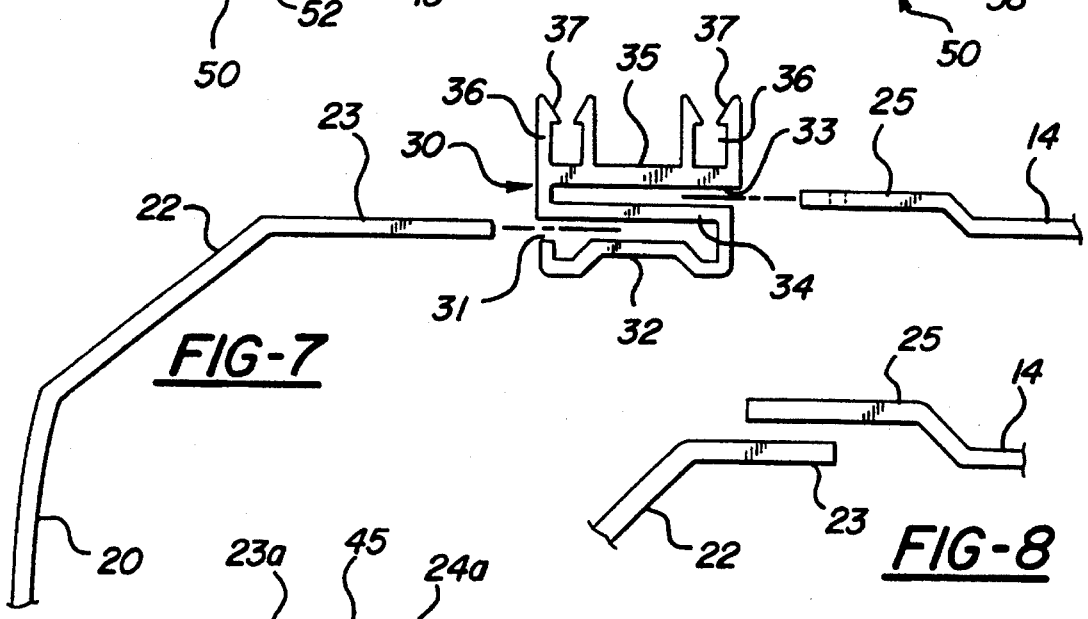
FIG-7
FIG-8
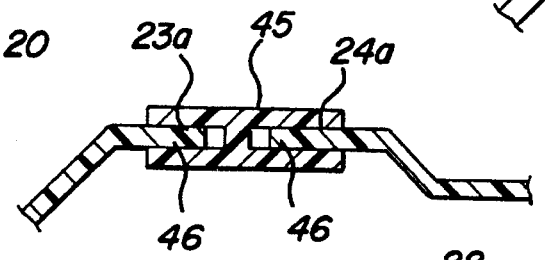
FIG-9
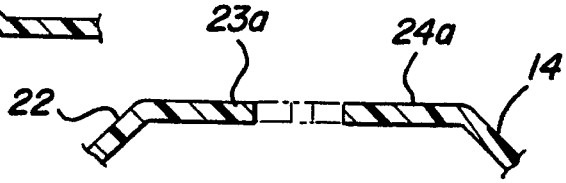
FIG-10

OUTDOOR TOILET CABANA

BACKGROUND OF INVENTION

This invention relates to the construction of a cabana or housing used for portable outdoor-type toilets. Such portable toilet cabanas are conventionally formed of thin, plastic sheets which are connected together, edge to edge, to form the housing enclosure. A doorway is formed at the front of the enclosure and a suitable door is hingedly connected over the doorway. Typically, a waste holding tank with a toilet construction are arranged within the enclosure. A plastic cover or roof extends over the top of the cabana and is connected to the upper edges of the walls.

The details and the arrangements of the parts forming the cabana in past constructions have been varied. However, examples of such types of cabanas or toilet housings are disclosed in U.S. Pat. No. 3,447,167 issued Jun. 3, 1969 to David B. Harding for a "Portable Toilet Cabana"; U.S. Pat. No. 3,835,480, issued Sep. 17, 1974 to George W. Harding for a "Chemical Toilet Cabana"; and U.S. Pat. No. 4,031,572 issued Jun. 28, 1977, to George W. Harding for a "Chemical Toilet Cabana Shell Section." In these cabanas, the walls were made either of multiple sections that were assembled together or of large plastic sheets that were molded to form the wall shapes.

The use of large molded plastic panels formed of plastic sheets is illustrated, by way of example, in U.S. Pat. No. 248,775 issued Aug. 1, 1978 to Clarence Brown for a "Portable Sanitation Unit"; U.S. Pat. No. 250,350 issued Nov. 21, 1978 to Frank T. Sargent for a "Portable Toilet Building," U.S. Pat. No. 349,578 issued Aug. 9, 1994 to Richard L. Tagg for a "Portable Toilet" and U.S. Pat. No. 304,082 issued Oct. 17, 1989 to George W. Harding for an "Outdoor Toilet Cabana." While these patents relate to the design or appearance of toilet cabanas, they generally illustrate utilizing large wall panels joined together to form cabana or housing enclosures.

Since large panels formed of plastic sheet material are inherently somewhat resilient or flexible, they tend to absorb impact forces that may be applied during transportation of the cabanas. However, securing such large panels together, to form an overall rigid housing, is a problem. One form of previously used connections between adjacent cabana walls involved bending the vertical free edges of the walls into angled wall edge sections which terminated in flanges. The adjacent flanges along the edges of the wall panels have been angled so as to arrange such flanges in face-to-face relationship and at an angle relative to the panels. In other words, the vertical, adjacent free edge flanges have been arranged in planes which were angled relative to the planes of their respective wall panels. The connected flanges formed rigid, vertically extending strips at the corners of the cabana. While this form of construction is satisfactory for fastening the wall panels together and for rigidifying the housing or cabana, it does require fairly accurate dimensions for the parts. Only small variations or tolerances in dimensions can be permitted for proper assembly of the wall parts. Since such wall panels are large in height and width and may be formed with numerous indentations or bends for decorative and strength purposes, making the panel dimensions accurately is difficult and presents manufacturing problems.

Examples of this type of panel corner connection are disclosed in U.S. Pat. No. 4,577,351 issued Mar. 25, 1986 to George W. Harding for a "Portable Toilet Cabana"; U.S. Pat. No. 4,831,671 issued May 23, 1989 to George W. Harding for a "Portable Toilet Cabana" and U.S. Pat. No. 4,918,765 issued Apr. 24, 1990 to George W. Harding for a "Portable Toilet Cabana." In each of these disclosures, the edges of the wall panels are bent into strip-like flanges that are arranged in a plane which is roughly 45 degrees to the planes of their respective wall panels. These flanges are connected together to form multi-layer, vertical joints which also provide a column-like construction for rigidifying the cabana. However, the dimensions of the parts must be accurate in order to facilitate assembly of the cabana.

Thus, this present invention relates to an improved system for joining together the major components of an outdoor toilet cabana, that is, the walls and root, which system permits considerable variation in the sizes of the individual components while still providing a rigid and an accurately dimensioned overall cabana construction. Further, disclosures of preferred embodiments of this invention are found in co-pending applications, U.S. Ser. No. 8/380,683, filed Jan. 30, 1995 (Attorney Docket No. 6823-00026) and U.S. Ser. No. 08/380,681, filed Jan. 30, 1995 (Attorney Docket No. 6823-00027) which disclosures are incorporated herein by reference.

SUMMARY OF INVENTION

This invention contemplates forming an outdoor toilet cabana or housing out of a pair of substantially identical, mirror image side walls which are formed of relatively thin sheets of plastic material. The sheets are thermo-formed into large wall panels whose opposite edges are bent, at roughly 45 degrees, out of the plane of the panel body portion, to form bent edge sections. These sections terminate in vertical, bent, free edge strip-like flanges. The flanges of one side wall extend towards, and are approximately in the same plane as, the corresponding flange on the opposite side wall. A substantially flat rear panel is provided. This rear panel has vertical side strip or flange portions which are arranged in substantially the same plane as the corresponding rear flanges of the side walls. The adjacent rear wall strips and side wall flanges are approximately co-planar and are secured together by extruded metal strips. These metal strips are provided with oppositely opening channels for receiving the adjacent flange and strip portions, preferably in overlapped relationship. The channels are relatively deeper than the portions of the strips and flanges that are fitted into them so as to accommodate for substantial variations in dimensions. That is, inaccuracies are accommodated by the depth of insertions of the wall flanges within the channels.

A molded or thermo-formed roof panel, formed with depending flanges, is arranged over the upper edges of the walls. The rear flange of the roof is fitted into a channel in an extruded metal strip which is similar to the metal strips that are used for the wall connections. The upper edge of the rear panel similarly fits into another channel in that extruded strip for connecting the roof to the rear panel.

The forward portion of the cabana, that is, the space between the vertical flanges formed on the forward edges of the side walls, provides a doorway over which a suitable door is mounted. The jambs and header of the doorway are formed by an extruded metal strip which is generally T-shaped in cross-section. One side of the head of the T-shape forms a door stop for the jamb and the header of the doorway. The other side of the head forms part of a channel which receives the adjacent flange of the side wall. The stem of the T-shaped strip is curled or bent into a J-shape to provide a drain channel which extends along the header or top of the doorway and along the sides or jambs of the doorway for draining rain water and the like. The roof forward flange, that depends from and is integral with the roof, extends downwardly into the same channel construction that receives the side wall flanges.

The lower edges of the wall panels and of the doorway jamb strips are fastened to a base or a pallet. Thus, the cabana may be lifted, or moved by moving its base. The cabana is intended for use as a toilet housing or cabana within which a waste holding tank having a toilet opening may be mounted. Alternatively, other forms of toilets may be mounted. This construction permits transporting the cabana with its toilet from one place to another, as is conventional, with outdoor types of toilets.

An object of this invention is to provide a simplified system for securing together the adjacent edges of the panels which form the cabana walls and which system accommodates relatively wide variations in dimensions which may result from manufacturing inaccuracies so as to reduce the costs of manufacturing the cabanas as well as to reduce the rejection of parts which are not accurately dimensioned.

Another object of this invention is to provide an inexpensive, simplified connection system for securing together the rear and side panels of a cabana while providing rigid, column-like supports for strengthening the construction and, simultaneously, providing a rigidified doorway construction which enables use of relatively inaccurately dimensioned side panels or rear panels or doors.

Still a further object of this invention is to provide a connector strip system for joining together the adjacent edges of the cabana panels, by extruded metal strips, in a way which rigidities and strengthens the overall cabana construction. Further, the strip connection system may include a resilient bumper arrangement which protects the cabana against damage which might be incurred by impacts during transportation or movement of the cabanas.

These and other objects and advantages of this invention will become apparent upon reading the following description, of which the attached drawings form a part.

DESCRIPTION OF DRAWINGS

FIG. 1 is a perspective front and side view of the cabana;

FIG. 2 is a front, elevational view of the cabana;

FIG. 3 is a rear, elevational view of the cabana, and

FIG. 4 is a top, plan view of the cabana.

FIG. 6 is an enlarged, partially fragmentary, view of a cross-section of the cabana showing the connections between the side and rear walls thereof.

FIG. 7 is an enlarged, cross-sectional view illustrating the rear wall and side wall connector strip with the adjacent wall sections positioned for insertion in the connector strip channels.

FIG. 8 is a schematic, enlarged view showing the overlapping relationship of the rear and side wall flanges.

FIG. 9 illustrates a modification of the connector strip in which the side and rear wall edge flanges are arranged edge to edge, rather than overlapped.

FIG. 10 is an enlarged, fragmentary view showing the aligned flanges of the modification of FIG. 9.

DETAILED DESCRIPTION

Figure 5:
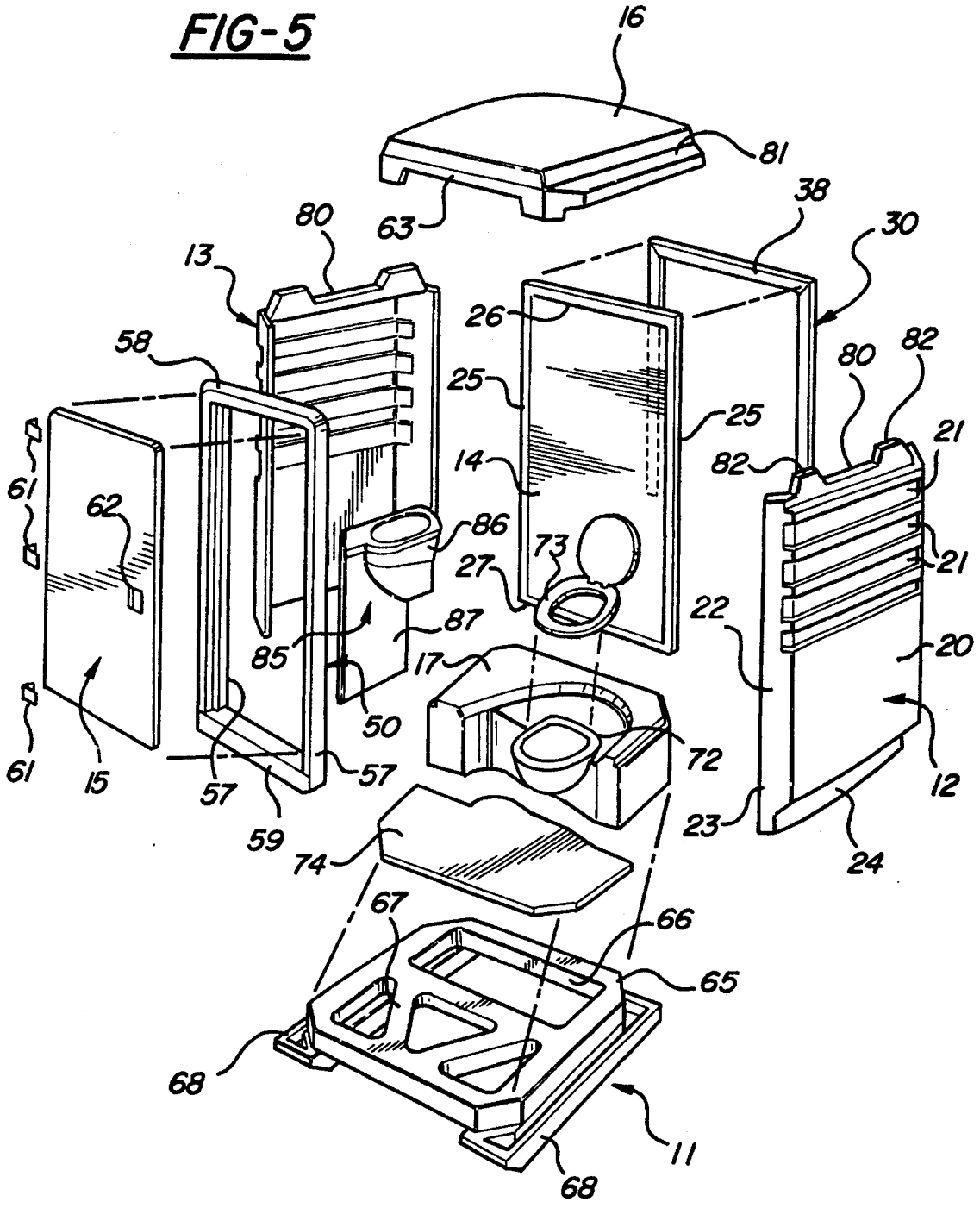
FIG. 5 is an exploded or disassembled view of the major parts of the cabana.

As shown in the drawings, the cabana 10 includes a base or pallet 11, opposing side walls 12 and 13, a rear wall 14, a door 15 and a roof 16. A toilet and waste material holding tank 17 is positioned in the cabana. Each of these components will be separately described.

The side walls 12 and 13, preferably, are mirror images of each other. That is, they are made out of a single thermoformed plastic sheet which is symmetrically formed. Therefore, they can be reversely arranged to form either a left or right side of the cabana. The side walls have a large panel face 20 which is substantially flat. Preferably, rather than forming the face truly planar, it is bowed outwardly a small amount. Also, the panel is formed with a series of indentations or channel-like depressions 21 which provide a decorative appearance as well as rigidify the panels.

The opposite corners of each side wall are bent into corner sections 22. These sections may be angled, such as about 45 degrees, to the panel face 20. The free edges of the corner sections are bent into vertical side edge flanges 23. These side edge flanges are approximately perpendicular to the plane of the panel face 20 so that the corresponding side edge flanges 23 at the rear of both side panels extend toward each other in substantially the same plane. Likewise, the side edge flanges at the forward portion of the cabana, that is, where the door and doorway are located, also extend towards each other and are substantially in the same plane. The lower edges of the side walls 12 and 13 are each provided with a lower edge, horizontally extending flange 24.

The cabana rear wall 14 is provided with opposite side flanges or edge strip portions 25. Similarly, the upper edge of the rear wall 14 is formed with an upper flange or strip portion 26. A lower flange or strip portion 27 is formed on the lower edge of the rear wall.

The adjacent rear wall side flanges and side wall edge flanges are connected together by means of a connector strip 30. Preferably, the connector strip is formed of an extruded metal, such as aluminum, of sufficient strength and rigidity. The connector strip is formed in a square S-shaped cross-section which provides an inner channel 31 whose inner wall is formed with a depressed, central wall section 32. In addition, the connector strip has an outer channel 33. The two channels share a common wall 34. The outer wall 35 of the outer channel is provided with a pair of integral, rearwardly opening rear or bumper channels 36. Preferably, the free edges of the walls forming the bumper channels are provided with a hook-like configuration 37. The connector strips extend along the sides of the rear panel 14. In addition, a connector strip portion 38 extends along the upper edge of the rear panel as illustrated in FIG. 5.

In the preferred embodiment illustrated in FIG. 8, the side edge flange 23 and the rear wall side flange or strip 25 are arranged in substantially parallel planes. Thus, the flange 25 overlaps the flange 23. As shown in FIG. 7, the flange 25 slips into the outer channel 33 of the connector strip 30. The side wall edge flange 23 slips into the inner channel 31 of the connector strip 30. The channels 31 and 33 are deeper than the anticipated lengths of the flanges 25 and 23 that fit within them. Thus, as illustrated in FIG. 6, the flanges 23 and 25 do not fill their respective channels but rather are spaced from the bottoms of these channels. Consequently, considerable room is allowed to accommodate for inaccuracies in the dimensions of the side walls and rear wall of the cabana. That is, the depth of entry of the flanges into the respective channel can be adjusted to obtain the desired overall width dimension of the cabana. Moreover, the free edges of the flanges need not be carefully trimmed or squared which substantially reduces the amount of labor that might otherwise be required for that purpose. Once the flanges 23 and 25 are inserted and frictionally held within their respective channels 31 and 33, rivets 39 may be applied to fix the parts together. (See FIG. 6.)

Figure 11:
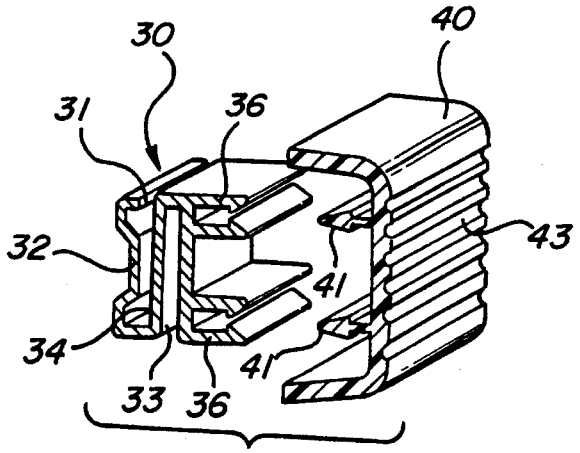
FIG. 11 is a fragmentary, cross-sectional and perspective view illustrating the wall connector strip with a bumper strip arranged in position for assembly thereto.

The connector strip is covered with a bumper strip 40. The bumper strip is made of a resilient plastic material, which is rubber-like in characteristic and is generally U-shaped in cross-section. The bumper strip 40 is shown in assembled position in FIGS. 6 and 12. FIG. 11 illustrates the bumper strip in position ready to be applied upon the connector strip.

The bumper strip 40 is held in place by integral prongs or tongues 41, that are shaped like arrow-heads, which fit into the bumper channels 36 on the connector strip 30. The arrow head prongs tend to interlock with the hooked ends 37 of the bumper channels to prevent removal of the bumper strip once they are inserted. The bumper strip is arranged to extend around and to cover the exposed portions of the connector strip. Thus, one of its purposes is to enhance the appearance of the rear of the cabana. Another purpose is to provide a resilient bumper to protect the cabana against damage due to impacts which occur during the transportation of the cabana to-and-from its sites of use. Normally, these cabanas are transported for one site to another upon trucks. When a number of cabanas are carried upon a truck, there is a tendency for them to strike each other during the jolting of the truck. Thus, the bumper strips prevent damage.

The bumper strips 40 may include grooves 43 or indentation stripes. These grooves or stripes enhance the appearance of the bumper strips and also, may increase the resilient movement of the portions of the bumper strips that sustain impacts.

Figure 12:
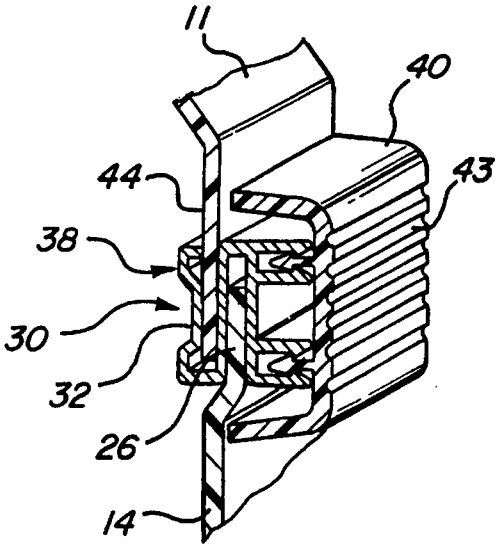
FIG. 12 is a fragmentary, cross-sectional view showing the assembly of the connector strip, the roof and rear wall flanges and the bumper strip.

As illustrated in FIG. 12, the cover or roof 16 of the cabana is provided with a rear, downwardly extended, flange 44. This flange fits into the inner channel 31 of the horizontal, upper portion 38 of the connector strip. The upper flange 26 of the rear panel fits into the outer channel 33 of the horizontal part 38 of the connector strip (see FIG. 12).

FIGS. 9 and 10 refer to a modified form of connector strip. This strip 45 is generally H-shaped in cross-section and is made of a suitable metal extrusion, such as aluminum, of sufficient strength for the purpose. Here, the strip is provided with opposed channels 45 into which the aligned flanges **23*a* and 24*a*** of the respective side and rear walls are inserted.

FIG. 10 shows the flanges arranged in a common plane rather than being slightly offset from the same plane, as illustrated in FIGS. 7 and 8. As illustrated in the drawings, the channels 46 are deeper than the portions of the flanges inserted into them so as to allow for variations in dimensions of the wall portions. Suitable rivets (not shown) may be used to fix the flanges within the channels.

Figure 13:
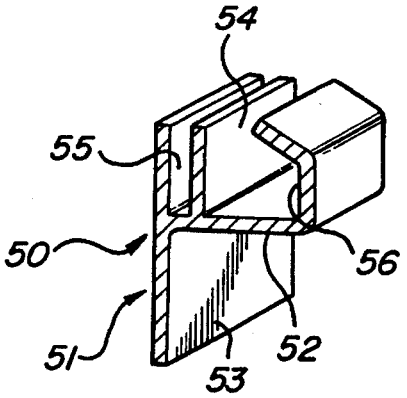
FIG. 13 is an enlarged, fragmentary, perspective view of the doorway strip.

Turning to the front of the cabana, the space between the opposed side wall flanges provides a doorway. The doorway is defined or outlined by a doorway strip 50. This strip is preferably formed of a metal extrusion (such as aluminum) which, as shown in FIG. 13, is T-shaped in cross-section to provide a head 51 and a stem 52. One side of the head provides a door stop flange 53. The other side of the head, along with an integral second flange 54, forms a channel 55. This channel receives the side wall forward flanges 23 (see FIG. 14). In addition, the stem part of the extruded strip is bent into a J-shaped cross-section to provide a water drain channel 56.

The doorway-defining strip is arranged to provide jamb portions 57 and a header portion 58 along the sides and top of the doorway. In addition, a sill strip 59 is fastened to the lower ends of the jamb portions 57. The sill strip may be of the same cross-section as the doorway strip or may simply be a flat or an angled, in cross-section, strip of metal. Thus, the strip 50 provides a doorway outline or frame.

The door 15, may be provided with an edge flange portion 60. A suitable gasket or padding strip (not shown) may be arranged around the edges of the door. Also, the door may be formed of a pair of overlapped panels, joined together at their edges to provide a rigid door panel (not shown). The door is provided with hinges 61 for connecting it to one of the jamb forming members 57. In addition, a latch mechanism 62 (shown schematically) may be mounted upon the door for closing and locking the door when the cabana is in use.

Figure 14:
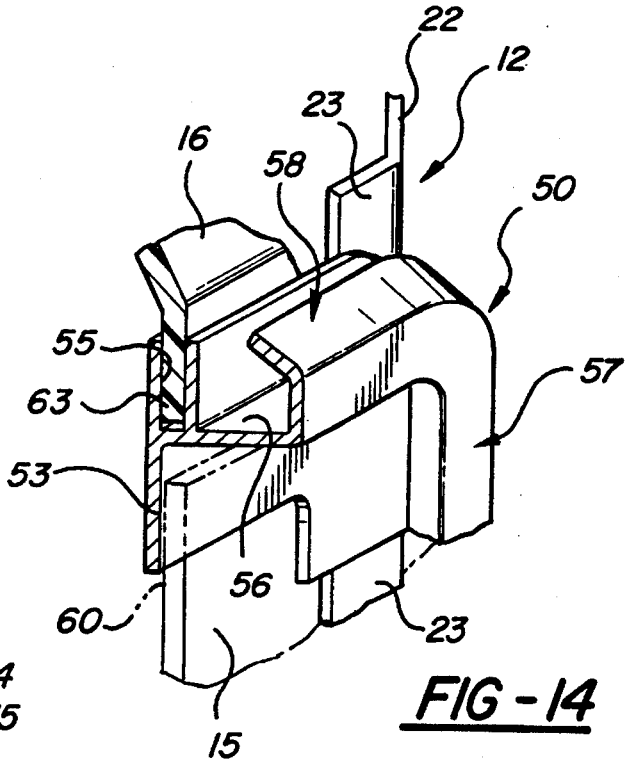
FIG. 14 is an enlarged, fragmentary, perspective view of a corner of the doorway defining strip illustrating a segment of the cover flange and side wall flange connected thereto and, in dotted lines, a door fitted therein.

The roof 16 is provided with a front edge flange 63 which is fitted within the channel 55 of the header portion 58 of the doorway defining strip 50 (see FIG. 14). Rivets or the like may be used to secure the parts together.

The cabana base 11, preferably, is in the form of a pallet frame 65. The pallet frame may be molded of a suitable, strong, durable, plastic material and is hollow (see, for example, FIG. 15). As illustrated in FIG. 5, the base or pallet frame is preferably formed with a rear socket forming opening 65 and forward supports or struts 66. Integral skids 68 are formed on the sides and lower surface of the base or pallet. These skids may have their lower surfaces provided with a series of beads or ribs 69 and **69*a* (see FIG. 15). Between the beads 69*a*, a plastic skid strip insert 70 may be positioned and fastened in place with suitable screws (not shown) so that the cabana unit may be slid upon the ground or upon a support surface. Thus, wear on the bottoms of the pallets of such. cabanas is taken by the inserts and, in the event of undue wear or damage, the worn inserts 70** may be removed and replaced with new inserts.

The cabana is primarily designed as a housing for an outdoor toilet. Thus, as shown in FIG. 5, a static waste-receiving toilet tank 17 is arranged upon the base or pallet 11 over the rear open socket portion. The lower portion of the tank may be extended downwardly (not shown) to form a portion that fits within the open socket portion 66 and to thereby stabilize the tank in position. A toilet opening 72 is provided on the upper surface of the toilet tank. A toilet seat and cover unit 73 is positioned over the toilet opening and may be held in place with suitable hinges (not shown).

The forward portion of the pallet is covered with a rigid floor panel 74 which may be formed of plywood or sheet plastic or the like to provide a floor upon which an occupant may stand.

Figure 15:
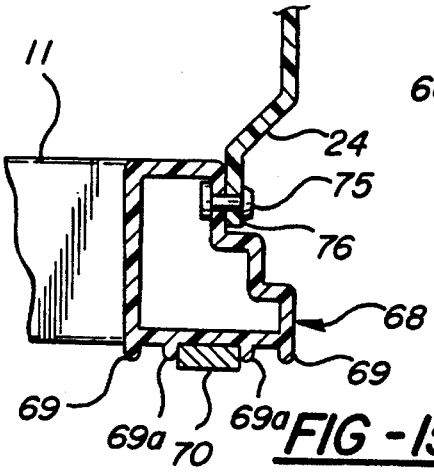
FIG. 15 is a cross-sectional view of a fragment of the base or pallet of the cabana with the lower edge of a side wall panel connected thereto.

The lower edge flanges 24 of the side walls of the cabana are fastened, such as by rivets 75 or screws or the like, to the sides, along side notches 76 formed on the base frame (see FIG. 15). The upper edges of the side walls are cut out to form depressions or elongated slots 80 which may provide ventilation openings beneath the sides of the overlapping roof. The roof may be formed with integral box-like side edge sections 81 which overlap enlargements 82 formed on the upper edges of the side walls. The roof edge sections may be fastened to the enlargements by suitable rivets or the like (not shown).

In addition, the cabana may include a sink unit 85 of suitable design. This includes a sink or washing bowl 86 which may be mounted upon a support that can be used as a water tank 87 (see FIG. 5). A suitable water pump can be installed for pumping water to the sink. Alternative arrangements of the toilet and the sink units within the cabana may be used. Thus, the drawings and the disclosure herein illustrate one embodiment of this arrangement.

As can be seen, the components forming the cabana are relatively simple in construction and the system for securing the components together is able to accommodate relatively wide discrepancies in dimensions or finishings of the edges of the wall and door components while still providing a strong, rigid and attractive cabana unit. Moreover, the components are so formed and so fastened together that they may be individually replaced in the event any one or more of the components are damaged during the transportation or use of the unit.

This invention may be further developed within the scope of the following claims. Thus, having fully described at least one operative embodiment of this invention;

It is now claimed:

1. An out-door toilet cabana comprising a pair of spaced apart, substantially vertical side walls and a substantially vertical rear wall connected to the side walls, a front doorway opening with a door, a roof and a base;

each of said side walls being formed of a large, generally planer panel having rear and front vertical edge portions that are bent at an obtuse angle towards the plane of the opposite side wall to form angled corner sections that are integral with the side wall panel, and with the free edges of the corner sections each being bent into a narrow, vertical edge flange which is directed towards and is arranged in approximately the plane of the corresponding flange formed on the opposite side wall corner section;

said rear wall being formed of a substantially flat panel having opposite, vertical side edge strip portions that extend towards end lie substantially in a plane parallel with the edge flanges formed on the rear edges of the side wall panels;

a pair of connector strips joining the adjacent rear wall strip portions and side wall flanges, with each connector strip being formed with a pair of sidewise opening channels which open in opposite directions, end with one channel of each connector strip receiving a rear wall strip portion and with the other channel each connector strip receiving a side wall flange for thereby connecting said strip portions to said flanges, end with each said channels being deeper than the strip portions of the rear panel and the side panel edge flanges respectively so as to accommodate variations in the dimensions in the walls in assembling a pre-determined size.

2. An outdoor toilet cabana as defined in claim 1, and wherein the connector strips are each formed in a generally squared S-shape in cross-section, rigid extrusion, and with the channels of each of the connector strips arranged side-by-side and having a common wall, whereby the respective rear panel edge strip and side wall flange received in said channels are arranged in parallel, overlapping relationship with said common wall between them.

3. An outdoor toilet cabana as defined in claim 2, and with one of the connector channels forming an outside channel defined by said common wall and an outside channel wall, and a rearwardly and outwardly opening channel formed on said outside channel wall;

an elongated, resilient, bumper strip having an integral tongue formed thereon, which tongue fits into and is frictionally held within said outwardly opening channel and with the bumper strip extending along and covering the outside channel wall.

4. A construction as defined in claim 2, and with one of the channels of said connectors forming an outer channel defined by an outer channel wall and said common wall, and with a spaced apart pair of rearwardly and outwardly opening bumper channels integrally formed on said outer channel wall;

an elongated, resilient, bumper strip having a spaced apart pair of integral tongues extending towards and fitted within said bumper channels and frictionally held within said bumper channels.

5. A construction as defined in claim 4, and with the opposite elongated edges of the bumper strip extending over and covering the outer portions of the connector strips for concealing the connector strips from visually view and for providing a protective bumper upon the rear wall of the cabana.

6. An outdoor toilet cabana as defined in claim 1, and with each of the connector strips being formed in a generally H-shaped cross-section for receiving and holding the respective rear panel edge strips and side wall flanges in substantially coplanar end-to-end, aligned relationship.

7. An outdoor toilet cabana as defined in claim 1, and including a connector strip portion extending over and receiving the upper edge of the rear panel;

and said roof having a depending flange portion extending into the other channel of said connector strip portion for connecting the upper edge of the rear panel to the roof.

8. A construction as defined in claim 1, and including a rigid, extruded door frame strip defining the doorway side jambs and header;

said strips being formed in a generally T-shaped cross-section to provide a head flange that is divided into two head flange parts by an integral stem flange extending perpendicular to the head flange;

a second flange formed integral with the stem flange and being parallel and spaced from one of said head flange parts to form a channel therewith for receiving the adjacent forward side wall flange portion and with said channel being dimensioned so as to be deeper than the portion of said side wall flange normally fitted therein so as to provide for adjustment for dimensional variations in the side wall.

9. A construction as defined in claim 8, and the free end of the stem flange of the door frame strips being bent into a channel so that the stem is substantially J-shaped in cross-section to form a drainage channel on said door frame strips with said channel extending along the header and jamb portions of the doorway for receiving and conducting water away from the doorway opening.

10. A construction as defined in claim 9, and including said roof having a depending, integral, forward flange portion extending into the channel formed between said head flange and said second flange with said channel being deeper than the normally dimensioned roof flange for accommodating variations in the dimensions of the roof flange.

11. An outdoor or toilet cabana comprising:

a pair of spaced apart side walls and a rear wall connected to the side walls, and a front doorway opening covered by a door, and a roof extending over the upper edges of said wails and a base to which the lower edges of the walls are connected;

each of said side walls being formed of a large generally planar panel having integral rear and front vertical corner portions that are bent at an angle to the plane of the respective wall to form angled corner sections;

each corner section having its free edge terminating in continuous, vertically elongated strip-like edge flange with the flanges of one side wall extending toward and being approximately in the same plane as the edge strips of the opposite side wall;

said rear wall being formed of a substantially flat panel having opposite, vertical side edge strip portions that extend towards and lie substantially in a plane parallel with the side edge flanges formed on the rear edges of the side walls;

elongated connector strips rigidly joining the adjacent rear wall strip portions and side wall edge flanges, with said connector strips being formed with a pair of substantially aligned channels that open in opposite directions and with one channel of each connector strip receiving a rear wall strip portion and the other channel of each connector strip receiving a side wall edge flange, and with said channels being deeper than the strip portions of the respective rear wall and the side wall edge flange portions that are positioned in said channels so as to accommodate variations in and to permit adjustments between the respective walls to form a pre-determined size cabana;

door frame strips arranged along the doorway opening and formed, in cross-section, in the shape of a channel opening sideways for receiving the adjacent side wall edge flanges and an integral portion extending into the doorway to form stops for the door, with such channel being dimensionally deeper than the portion of the side edge flanges normally fitted within such channel so as to accommodate and permit adjustments of varying dimensions of the side walls in forming a pre-determined dimension cabana.

12. An outdoor toilet cabana as defined in claim 11, and including the channel formed on said door frame strips having a base and a pair of spaced apart side walls to define the channel, with the base being extended to form a generally J-shaped channel portion which is positioned on the front of the cabana;

and with said strips having a portion arranged over the header part of the doorway, wherein the outer channel provides a drain gutter along the header and jambs of the doorway for directing rain water and the like away from the doorway, and with the channel of the strip portion extending along the header receiving a depending flange formed integral with the roof, for connecting the roof front portion with said door frame strip header portion.

13. A construction as defined in claim 12, and with the connector strips being formed in a generally squared S-shaped cross-section so that the channels of each of the connector strips are arranged side-by-side, opening in opposite directions, and having a common wall between said channels for receiving and holding the rear panel edge strip and the side wall flange in parallel, overlapping relationship, separated by the common wall.

14. A construction as defined in claim 12, and including a connector strip portion extending over the upper edge of the rear panel for receiving the free edge portion of the upper edge of the rear panel and with said roof having a rear, depending flange portion arranged within the other channel of the upper connector strip portion for connecting the roof to the rear panel.

15. A construction as defined in claim 14, and including a substantially continuous, resilient, bumper strip covering the externally exposed surfaces of the connector strip and secured to the connector strip by means of an integral tongue fitted within an integral tongue receiving channel formed on the rearwardly exposed surface of the connector strip.

16. A construction as defined in claim 11, and with each of the connector strips being formed in a generally H-shape for receiving and holding the rear panel edge strip and side wall flange in substantial co-planar end-to-end relationship.

* * * * *